US006065747A

United States Patent [19]

Khovaylo et al.

[11] Patent Number: 6,065,747

[45] Date of Patent: May 23, 2000

[54] SHEET SUPPORT TRAY WITH COMPENSATION FOR CURLED SHEETS

[75] Inventors: Modest Khovaylo; Rodney C. Harris, both of Fort Collins, Colo.

[73] Assignee: Hewlett-Packard Company, Palo Alto, Calif.

[21] Appl. No.: 09/031,754

[22] Filed: Feb. 27, 1998

[51] Int. Cl.[7] ..... B65H 31/00

[52] U.S. Cl. ..... 271/209; 271/161

[58] Field of Search ..... 271/207, 209, 271/161; 399/405, 406

[56] References Cited

U.S. PATENT DOCUMENTS

| | | | |
|---|---|---|---|
| 4,361,319 | 11/1982 | Ikeda et al. | 271/209 |
| 4,898,374 | 2/1990 | Vermaat | 271/209 |
| 5,111,252 | 5/1992 | Hamada et al. | 271/171 |
| 5,232,216 | 8/1993 | Bybee . | |

FOREIGN PATENT DOCUMENTS

| | | | |
|---|---|---|---|
| 0198252 | 11/1984 | Japan | 271/209 |
| 0064969 | 3/1989 | Japan | 271/209 |
| 0267258 | 10/1989 | Japan | 271/207 |
| 406056328A | 3/1994 | Japan | 271/209 |

*Primary Examiner*—H. Grant Skaggs

[57] ABSTRACT

A sheet support tray having an upstream end portion, a downstream end portion and a sine wave shaped sheet support portion extending between the end portions and having at least one crest and two troughs, which is adapted to cause at least the trailing edge portion of a sheet having curled ends to lie relatively flat in the tray to avoid paper jams with the leading edge of an incoming sheet. Structure for facilitating grasping of a sheet in the tray is also described.

17 Claims, 9 Drawing Sheets

SHEET SUPPORT TRAY WITH COMPENSATION FOR CURLED SHEETS

BACKGROUND OF THE INVENTION

The present invention relates generally to a sheet support trays and, more particularly, to a sheet support tray adapted to prevent jamming when the tray is receiving sheets having curled up ends.

Many paper processing devices, such as for example laser printers, heat and dry out one side of a sheet of paper which is being processed more than the other side. This differential heating and drying causes the paper to curl up at the ends when the more heated/dried side of the paper is placed in a face up orientation on a flat surface. When such sheets of paper are subsequently handled, either in the device applying the differential heat or in other devices such as an automatic document feeder (ADF), the curled up ends of the sheets tend to cause problems. An automatic document feeder is described in U.S. Pat. No. 5,232,216 of Bybee which is hereby incorporated by reference for all that it discloses. An automatic document feeder for an optical scanner takes sheets, one at a time. from a paper tray and feeds the sheets in series across a scanner platen. The ADF then deposits these sheets, one on top of the other, in a paper discharge tray. The leading edge of each sheet is pushed across the top surface of the immediately preceding sheet as it enters the paper discharge tray. If the trailing edge of the sheet lying in the tray is curled up, the leading edge of the next incoming sheet tends to catch on it and cause a paper jam.

Another problem experienced with paper trays, particularly discharge end paper trays, is that due to static electricity or simply due to the small thickness of the paper, it is difficult for a user to grasp the paper to pull it out of the tray.

It would be generally desirable to provide a paper tray which overcomes the above discussed problems.

SUMMARY OF THE INVENTION

The present invention is directed to overcoming the above discussed problems in the art.

The invention may thus comprise a sheet support tray for use with a sheet processing machine of the type which discharges sheets from a discharge port in a longitudinally extending downstream direction with a leading longitudinal end of each discharged sheet exiting the machine first and a trailing longitudinal end of each discharged sheet exiting the machine last. The sheets have leading and trailing ends which curl upwardly when the sheet is positioned on a flat surface. The tray has a first laterally extending sheet support portion which supports a portion of a curled end sheet in contact therewith at a first height and a second laterally extending sheet support portion positioned downstream from the first sheet support portion which supports a portion of a curled end sheet in contact therewith at a second height. The second height is sufficiently greater than the first height to cause the trailing edge of a sheet supported on the tray to be positioned in substantially tangential relationship with the first laterally extending sheet support portion.

The invention may also comprise a sheet support tray having an upstream end portion, a downstream end portion and a sine wave shaped sheet support portion extending between the end portions and having at least one crest and two troughs. The sine wave-shaped sheet support portion may have a first trough positioned proximate the upstream end portion, a first crest positioned downstream from the first trough, a second trough positioned downstream from the first trough and a second crest positioned proximate the downstream end and downstream from the second trough. The sine wave-shaped sheet support portion may have a plurality of longitudinally extending ribs. The sine wave-shaped sheet support portion which extends from between said second trough and the second crest may include a generally truncated converging half pipe-shaped portion having a lower surface portion and opposite upper edge portions. The generally truncated converging half pipe-shaped portion may be constructed and arranged to form a gap between a sheet of paper supported thereon and the lower surface portion thereof to facilitate easy insertion of an operator's finger below the sheet of paper to enable easy grasping and removal of the sheet of paper from the tray.

The invention may also comprise a method of supporting a sheet of paper having a curled up trailing edge on a support tray comprising placing the sheet in contact with the tray and elevating a mid portion of the sheet sufficiently so that a trailing edge portion of the sheet is positioned in about a tangential orientation with the surface of the tray. The method may further comprise providing a finger insertion gap between a leading edge portion of the sheet and a lower surface of the support tray by placing the leading edge of the sheet in contact with a generally truncated converging half pipe-shaped structure on the support tray.

The invention may also comprise a method of moving a sheet of paper across the surface of a support tray comprising: initially urging a first end portion of the paper against a first surface portion of the support tray; next elevating the first end of the sheet by urging it against a second surface portion of the support tray; next lowering the first end of the sheet by urging it against a third surface portion of the support tray; and next raising the first end of the sheet by urging it against a fourth surface portion of the support tray.

BRIEF DESCRIPTION OF THE DRAWINGS

An illustrative and presently preferred embodiment of the invention is shown in the accompanying drawing in which.

DETAILED DESCRIPTION OF THE INVENTION

Figure 1:
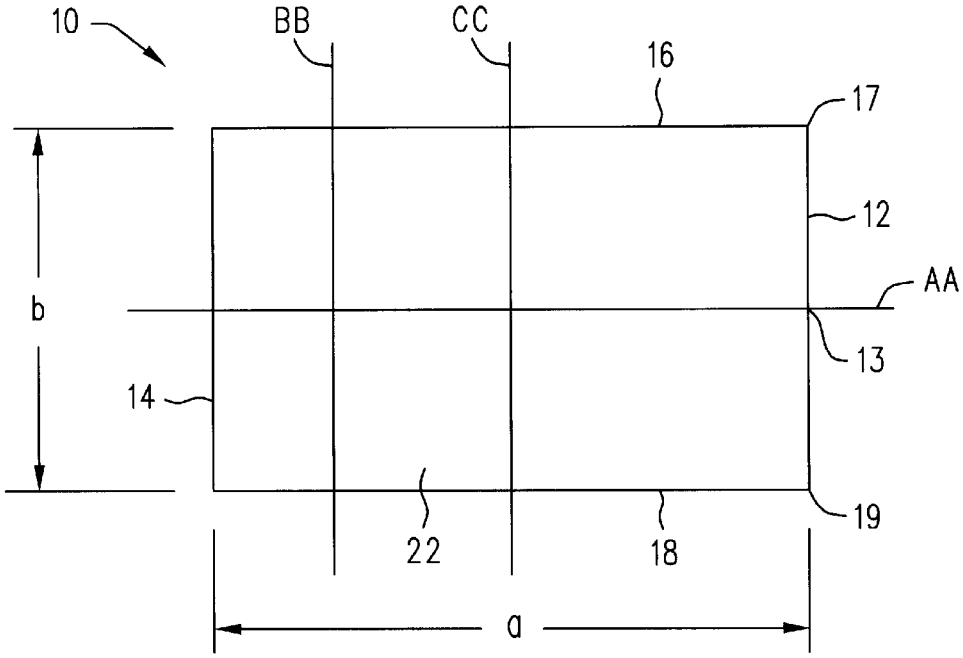
FIG. 1 is a top plan view of a sheet of paper.
Figure 2:
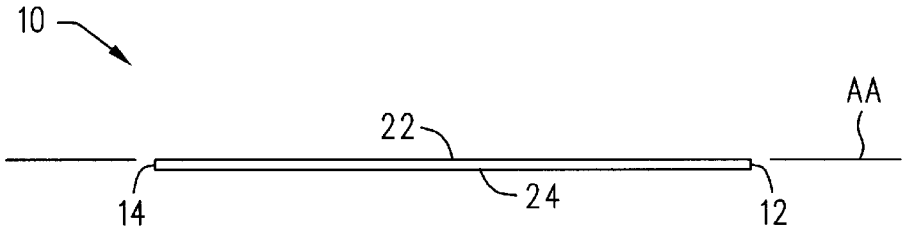
FIG. 2 is an elevation view of the sheet of paper of FIG. 1.

FIGS. 1 and 2 illustrate a sheet of paper 10 having a central longitudinal axis AA and a plurality of lateral axes BB, CC, etc. extending transversely of AA. The sheet of paper has a first or front longitudinal end portion 12 having a point 13 at the edge thereof on axis M. The sheet of paper further includes a second longitudinal end portion 14, a first lateral side portion 16 having a corner 17 and a second lateral side portion 18 having a corner 19. The sheet of paper has a length "a" and a width "b" which, in the case of a legal size sheet of paper, are 8½ in. and 14 in., respectively. The sheet of paper has an upper surface 22 and a lower surface 24. The sheet of paper may be a relatively thick, stiff sheet of paper such as heavy bond typing paper or a relatively thin, flexible sheet of paper such as onion skin paper, or may be of any intermediate thickness and stiffness. The thickness/stiffness of a sheet of paper will effect its "critical overhang length" (defined below). Sheets of paper are of course well known in the art and FIGS. 1 and 2 merely set forth terminology which will be used herein.

Figure 3:
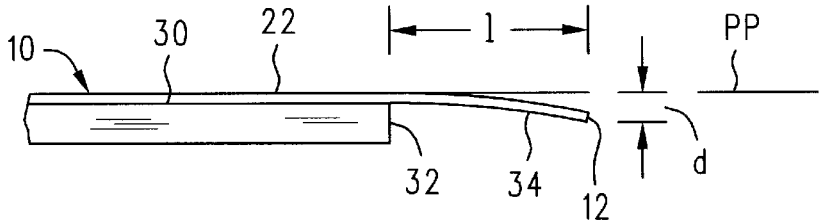
FIG. 3 is an elevation view of a sheet of paper supported on a planar surface with a portion thereof overhanging the planar surface.
Figure 4:
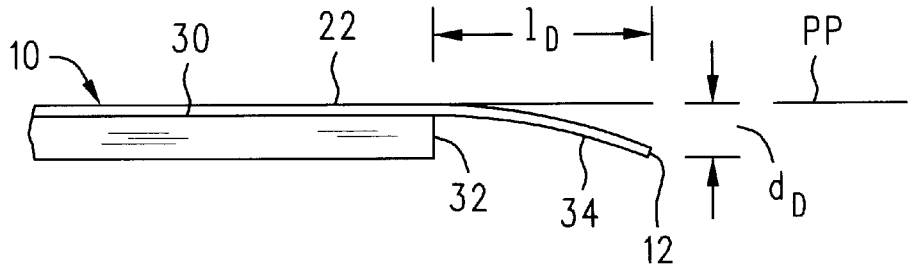
FIG. 4 is an elevation view of a sheet of paper supported on a planar surface with a portion thereof overhanging the planar surface by an amount equal to the critical overhang length of the paper.

FIG. 3 illustrates sheet 10 supported on a planar support surface 30 having a terminal end 32 and having a horizontal plane PP projecting outwardly from end 32. Sheet 10 has an overhanging portion 34 extending beyond terminal end 32 of the planar support surface by a horizontally measured distance "I". Longitudinal end portion 12 of the sheet 10 is deflected downwardly from horizontal plane PP by gravity by a vertically measured distance "d" referred to herein as "droop distance" or simply "droop". The droop distance d is measured from plane PP to the center point 13 at the overhanging end 12 of the sheet. The downward sagging of an unsupported end of a sheet is referred to herein as "drooping." As a sheet of paper is moved so that the amount of horizontal overhang I is increased, the amount of downward deflection or droop d tends to increase due to the greater bending moment placed on the overhanging portion by the force of gravity. The ratio of d to I, i.e., d/I is referred to herein as the "droop ratio" of the sheet and varies with the overhang length. Generally, the larger the amount of overhang, the larger the droop ratio becomes with a significant increase occurring at a length of around 2 or 3 inches for most business quality typing paper. "Critical overhang length" ("$I_c$", FIG. 4) as used herein, refers to the horizontally measured overhang length of a sheet of paper supported in a planar configuration such as shown in FIGS. 3 and 4, at the position on the support surface when the droop ratio d/I is equal to 0.25. "Critical droop distance" ($d_c$) is the droop distance of the sheet when it is supported in a planar configuration and when d/I is equal to 0.25. Although in the examples illustrated in FIGS. 3 and 4 the sheet 10 is shown supported on a horizontal surface, it is to be understood that the above discussed parameters also apply to a sheet supported on an upwardly inclined surface wherein the overhang length I refers to the horizontal projection of that inclined sheet and the droop d refers to the vertical drop of an end portion of the sheet from the point that the end portion would have occupied if the sheet extended parallel to its support surface.

As previously stated, the critical overhang length of different types of paper or other sheets of material vary significantly depending upon the longitudinal stiffness of the sheet. For example, a sheet of stiff, heavy weight bond paper will have a relatively long critical overhang length whereas a thin, low tensile strength sheet of paper such as onion skin paper will have a relatively short critical overhang length. The vertical amount d that a given horizontal overhang length I of a sheet droops typically varies somewhat with time and accordingly, critical overhang length and critical droop distance as used herein are determined at a point in time when the subject sheet of paper has been supported in an overhang position for a period of one minute. Temperature and humidity may also effect critical overhang length and thus unless otherwise specified herein critical overhang length $I_c$ for a sheet of paper is to be measured at standard temperature and humidity conditions such as are typically found in most modern air conditioned office environments.

Figure 5:
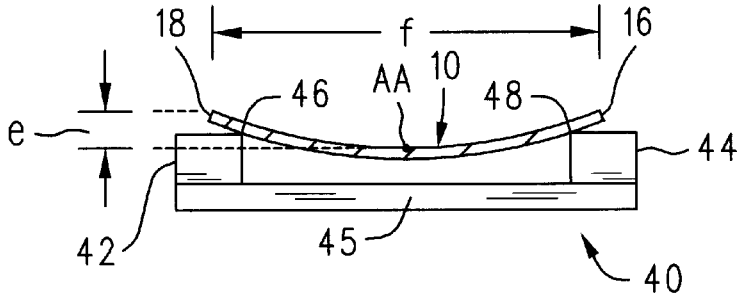
FIG. 5 is a cross-sectional end elevation view of a sheet of paper supported on a bow-forming sheet support structure.
Figure 6:
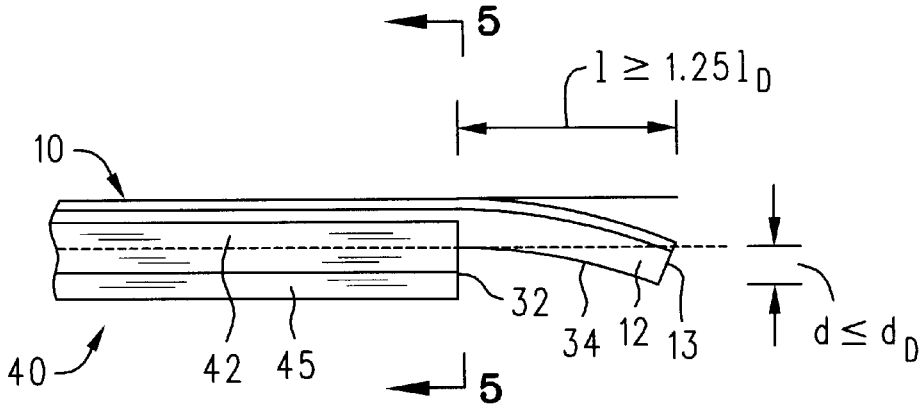
FIG. 6 is a side elevation view of a sheet of paper supported on the bow-forming sheet support structure of FIG. 5.

FIGS. 5 and 6 illustrate one embodiment of a bow-forming sheet support structure 40. In this embodiment, the bow-forming sheet support structure comprises first and second elongate, parallel rib members 42, 44 fixedly supported on a cross member 45. The rib members 42, 44 are spaced sufficiently far apart to cause the central longitudinal axis AA of the paper, including point 13, to be deflected downwardly relative to the first and second lateral side portions 16, 18 of the sheet. Thus the sheet has a bow-shaped cross section when supported by this structure. The relative amount of bowing at any cross sectional portion of the sheet may be represented by a bow ratio "e/f" where "e" is the vertical height between axis AA and a line drawn between the edges of lateral side portions 16, 18 of the sheet and where "f" represents the distance between lateral edges. In one preferred embodiment of the invention, the bow ratio of the paper e/f at the terminal end 32 of support structure 40 is sufficient so that the horizontal length I of the sheet is at least 25% greater than the critical overhang length $I_c$ of the sheet at the overhang position where the bowed sheet droops by an amount $d_c$. (It is to be understood that the parameters $I_c$ and $d_c$ are always determined for the subject sheet when the sheet is supported in a planar configuration.) A sheet having such a horizontal overhang extension ($1.25I_c$) or greater extension without drooping more than the critical droop distance $d_c$ is referred to herein as being erect or being in an erect state. A bow ratio e/f of about 0.02 or more in the cross section of the paper positioned at the terminal end 32 of the support structure is sufficient to place sheet of typical business grade typing paper such as twenty pound, bond office stationary, in an erect state.

Figure 7:
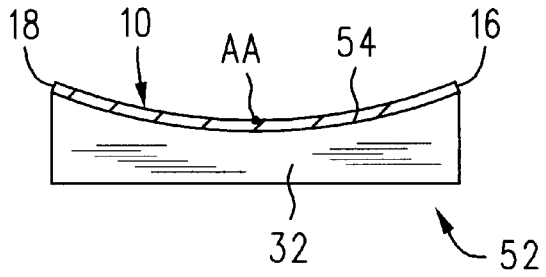
FIG. 7 is a cross-sectional end elevation view of another bow-forming sheet support structure having a sheet of paper supported thereon.
Figure 8:
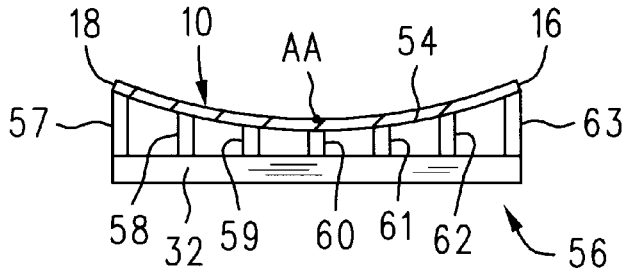
FIG. 8 is a cross-sectional elevation end elevation view of another bow-forming sheet support structure having a sheet of paper supported thereon.

The bow-forming structure of FIGS. 5 and 6 illustrates a bow formed by two spaced-apart ribs with no lower support for the paper, i.e. the depth e to which the paper sags is limited only by the tensile strength of the paper in the width direction. FIG. 7 illustrates another bow-forming structure viewed from a terminal end 32 thereof, with the paper sheet supported thereon shown in cross section. This structure has a continuous bow-shaped surface 54 which supports the paper sheet at all points across the width thereof. FIG. 8 is an end view of another embodiment of a support structure in which the paper is supported by a multi-ribbed, bow-shaped support surface 56 comprising ribs 57 through 63.

Figure 9:
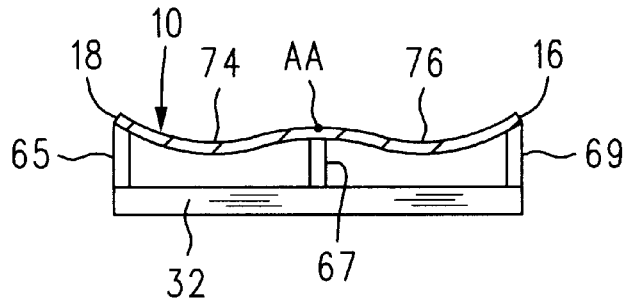
FIG. 9 is a cross-sectional end elevation view of dual bow-forming sheet support structure and a sheet of paper supported thereon.

FIG. 9 illustrates a compound bow-forming support structure comprising outer ribs 65, 69 positioned at a first elevation and central rib 67 positioned at a second elevation. The compound bow shape could be formed by use of many more ribs or a continuous surface as well as the 3 rib configuration. For supporting extremely wide sheets, multiple compound bow-shaped configurations could be used. Thus, FIG. 9, as well as FIGS. 5–8, all represent bow-forming structures which may be used to place a sheet of paper in a configuration having greater longitudinal stiffness than a flat sheet of paper thus increasing the length I which may overhangs the end portion 32 of a document support surface without drooping.

FIGS. 5 and 6 illustrate a bow forming structure that urges a sheet of paper supported thereon into a bow shaped configuration along its entire length. In many applications it is desirable that the second end 14 of the sheet remain in a planar configuration. For example an infeed tray or discharge tray of a printer or automatic document handler may experience paper jamming if the end of the paper proximate the infeed/discharge port is not flat. In such applications it is generally desirable to have a bow forming structure positioned only at the end of the support structure remote from the infeed/discharge port and extending no more than about one third the length of the paper sheet. Paper trays incorporating this concept are disclosed below.

Figure 10:
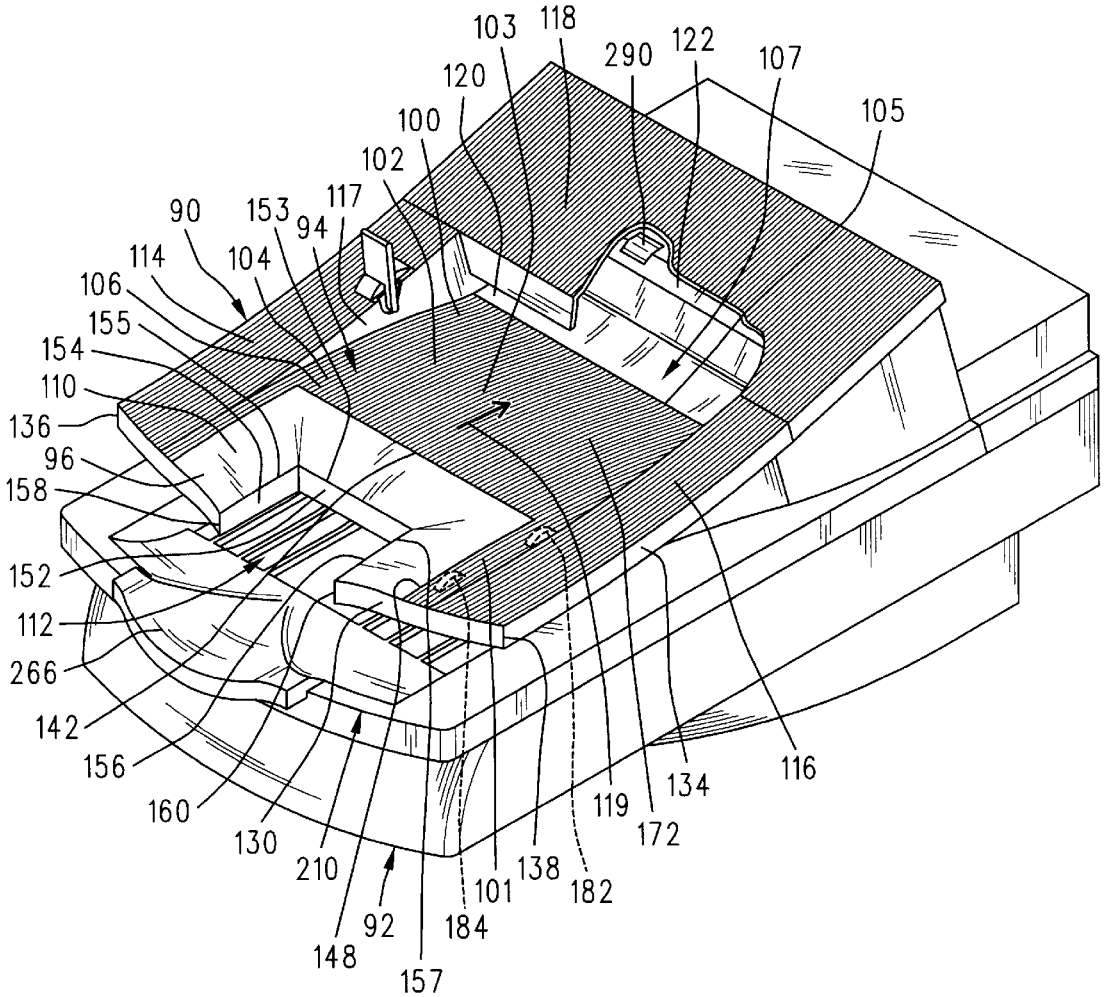
FIG. 10 is a perspective view of an automatic document feeder with an upper and lower sheet support tray which is mounted on an optical scanner.

FIG. 10 shows an automatic document feeder 90 mounted on an optical scanner 92. The automatic document feeder 90 includes an upper paper tray 94 which acts as an infeed tray. The tray has a first (front) longitudinal end 96, a second (rear) longitudinal end 98, a first lateral side 100 and a second lateral side 101. The tray includes a paper support surface 102 adapted to contact the bottom surface 24 of a sheet of paper 10 positioned thereon. The paper support surface 102 may comprise a generally flat, ribbed surface 103 having longitudinally extending ribs 104, 106, etc. which may be spaced at intervals of about ⅛" and which may have a height above a flat surface of about 1/64". The rib surface 103 terminates proximate the rear longitudinal end 94 of the support tray at rear border 105 and thereafter, the surface indicated as 107, may be flat and unribbed. The tray also includes an unribbed multi-curved surface 110 located proximate end 96 which is defined, in part, by a cut-out 112 positioned at the center of front longitudinal end 96. Tray 94 may include vertically projecting guide rails 114, 116 positioned adjacent to the lateral sides thereof. The guide rails comprise vertical surfaces 117, 119. Tray 94 may be partially covered by a housing lid 118 which may house drive rollers, etc. (not shown) which may operate in a conventional manner to draw paper stacked on the support tray into the automatic document feeder in feed direction 119. A vertical gap 120 between the front bottom portion of lid 118 and paper support surface 102, which may be e.g., "½" initially, reducing to about ⅛ inch about ¾ inch re farther in, allows papers stacked on surface 102 to slide under the housing lid 118 and come into abutting contact with a paper abutment surface or stop 122. A paper infeed mechanism (not shown), which may be of a conventional type, pulls sheets from the top of the paper stack one at a time and moves each sheet through the automatic document feeder and then out a discharge port onto lower paper tray 210. Paper infeed an handling mechanisms for automatic document feeders are well known in the art and will thus not be further described.

Upper tray longitudinal end 96 terminates at vertical terminal wall portion 130 which intersects vertical terminal wall portions 132,134 of lateral rails 114 and 116 at corners 136 and 138.

Figure 11:
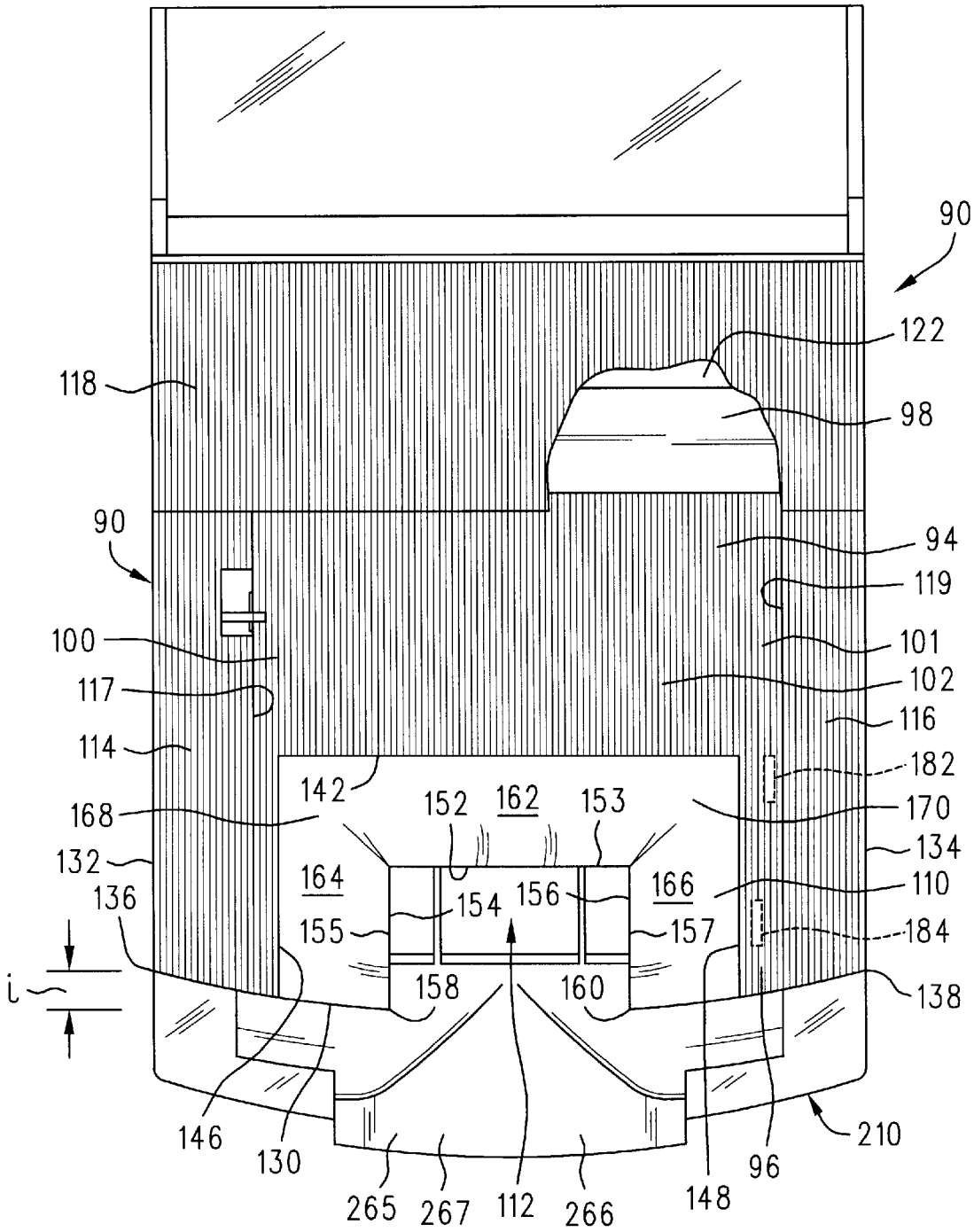
FIG. 11 is a top, partially cut-away plan view of the automatic document feeder of FIG. 10.

Unribbed surface 110 includes a laterally extending border 142 and longitudinally extending borders 146,148 which border the ribbed surface portion 103. The front end cut-out 112 may be defined by laterally and vertically extending terminal wall portion 152 and longitudinally and vertically extending wall portions 154 and 156. Wall portion 152 intersects the curved upper surface of unribbed surface 110 at intersection line 153. Vertical wall portions 154 and 156 intersect the curved upper surface of unribbed surface 110 at linear intersection lines 155 and 157. Longitudinally extending wall portions 154,156 intersect vertical terminal wall 130 at corners 158, 160. A laterally extending, generally rectangular-shaped portion 162 of surface 110, FIG. 11, slopes forwardly and downwardly and may have a radius of curvature of about 6½ inches and a total vertical drop of about ¼ inches. Unribbed surface 110 comprises first and second longitudinally extending, generally rectangular portions 164 and 166 positioned in mirror image relationship. These longitudinally extending portions slope inwardly and downwardly and may comprise a radius of curvature of about 6–12 inches and a total vertical drop of about 1/inch. The laterally extending portion 162 intersects with the longitudinally extending portions 164, 166 at intersection regions 168, 170, respectively. The curvature in these intersection regions may vary to provide a smooth blending of the curves of the respective curved portions 162,164 and 166.

Figure 12:
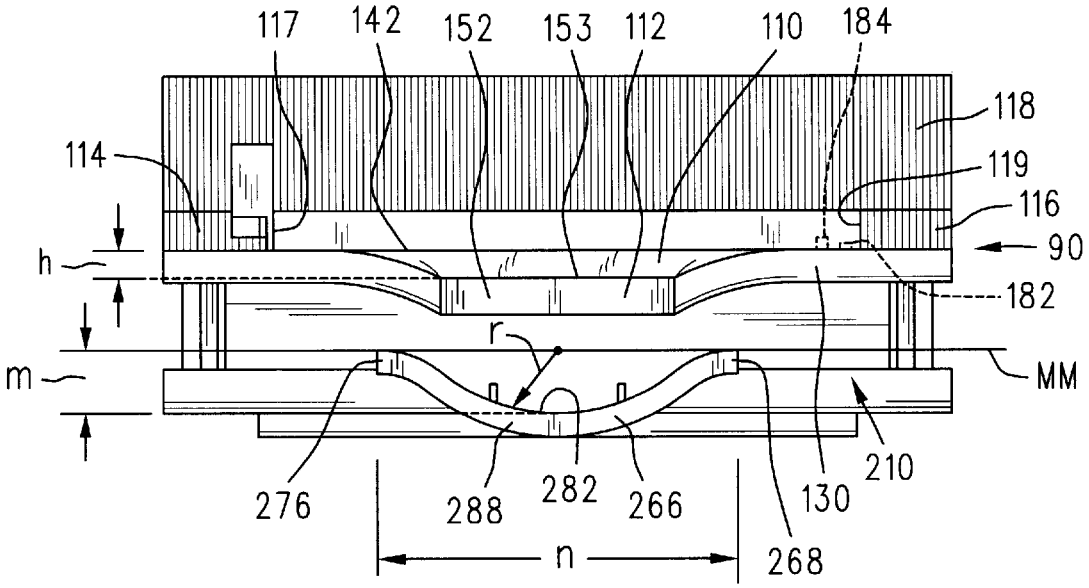
FIG. 12 is a front end elevation view of the automatic document feeder of FIG. 10.

The distance between vertical terminal walls 117,119 may be about 8 and ¾ inches. The length of the paper tray between longitudinal ends 96 and 98 thereof, i.e., between vertical terminal wall portion 130 and abutment surface 122 measured along the rib surface portion next adjacent one of the guide rails may be about 10 and ½ inches. The unribbed area 140 may have a width measured along border 142 of about 7 and ½ inches and may have a length measured from border 142 to vertical wall 130 along borders 146 and 148 of about 4⅝ inches. The corners 158,160 of the cut-out portion are positioned a longitudinal distance "i" from corner portions 136, 138 of the guide rail and i may be about ⅜ inches. Front vertical wall 130 may have a radius of curvature in the plan view of FIG. 11 of about 30 inches. The drop "h" from border 142 to edges 153, 155, 157, as illustrated in FIG. 12, may be about ¼ inches. The longitudinal length of intersection line 155 and intersection line 157 may each be about 3 inches. The lateral dimension of intersection line 153 may be about 4¼.

The ribbed surface portion 103 of the paper support surface 102 may slope downwardly and rearwardly from a point about even longitudinally with cut-out wall 152 and may extend forwardly generally horizontally from that location. In one preferred embodiment, the vertical surface 152 of the cut-out may be about 7½" (measured along the surface) forward of abutment surface 122 and the downward slope from the portion of the rib surface adjacent 152 may extend to about 1 inch forward of abutment surface 122. The rib surface 103 may terminate at 105 and a flat, unribbed surface 107 may extend from the edge of the rib surface to the abutment surface 122. The total drop of the rib surface as it proceeds rearwardly may be about 3–4 inch. The front generally flat portion of the rib surface is indicated at 174 and 176 and comprises a portion on either side of the unribbed surface.

As illustrated in FIGS. 10–12, 14 and 15 in phantom, the paper support surface 102 of the upper paper tray 94 may, in the alternative, be provided with generally half disk-shaped paper guides 182, 184 adapted to guide legal/letter width sheets and A4 width sheets, respectively. Each guide may have a thickness of about ⅛ inch and may be about 1 inch long and about 3/16 inch high and may have a radius of curvature of about ¾ inch. guide 182 may have a central longitudinal axis positioned parallel to surface 119 and spaced 9/16 inch therefrom. Guide 184 may have its central longitudinal axis spaced 5/16 inch from surface 119. The rear edge of guide 182 may be at the same longitudinal position as border 142. The forward edge of guide 184 may be positioned about 7/16 inch rearwardly of corner 160. In operation, guide 182 and surface 117 serves to guide a lateral edge portion of a legal/letter sized sheet of paper to maintain it in a straight orientation in the tray. Guide 184 and surface 117 perform the same function for A4 width sheets. When a letter/legal width sheet is discharged into the paper tray, the leading edge rides up and over guide 184. Thus, guide 184 acts to support a portion of a letter/legal-sized sheet above the surface of tray 102 and acts as a portion of the tray structure which causes the end of the supported sheet to adopt a generally bow-shaped configuration.

Figure 13:
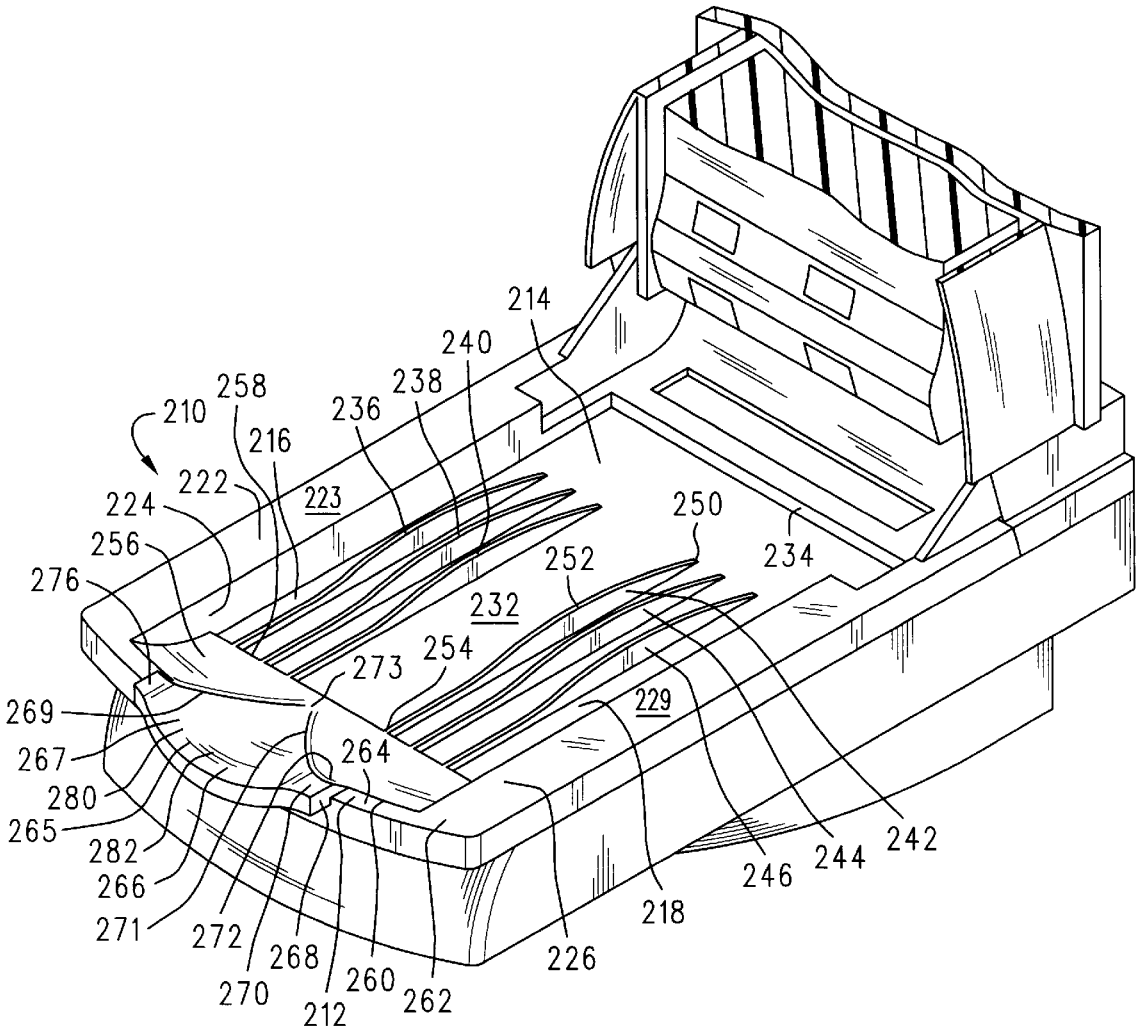
FIG. 13 is a perspective view of the automatic document feeder of FIG. 10 with the upper tray portion thereof in a raised position and broken away to expose details of the lower tray.

A lower paper tray 210 which may comprise a discharge paper tray is best shown in FIG. 13 which shows the upper paper tray 90 pivoted upwardly and broken away to expose details of the lower paper tray. The lower paper tray 210 includes a first or front longitudinal end 212, a second or rear longitudinal end 214 and a first lateral side 216. A first longitudinally extending guide rail 222, having a top surface 223 and an inner vertical side surface 224, is positioned adjacent the first lateral side 216 and a second longitudinally extending guide rail 226 having a top surface 227 and a vertical surface (not shown) in mirror image relationship to surface 224 is positioned adjacent second lateral side 218. The lower tray 210 may comprise a flat, horizontally extending base surface 232. A rear abutment surface 234 projects vertically upwardly from the flat horizontally extending surface. A plurality of generally identically shaped vertical ribs 236, 238, 240, 242, 244, 246, which may each be about 1/16 inch thick, extend parallel to vertical surface 224 of guide rail 222. First rib 236 may be positioned one inch from guide rail surface 224, second vertical rib 238 may be positioned one inch from vertical rib 236, vertical rib 240 may be positioned ¾ inch from vertical rib 238. Vertical rib 242 may be positioned 2 and ½ inches from vertical rib 240. Vertical rib 244 may be positioned ¾ inch from rib 242. Rib 246 may be positioned one inch from rib 244 and one inch from the inner vertical wall surface of second guide rail 226.

As shown by FIG. 13, each of the vertically extending ribs 236, 238, etc. may have a generally sine wave-shaped configuration. The first end of each rib 250 may comprise a first trough portion of the rib which may have a height of 0 inches above the flat, horizontal-extending base 232. This point 250 on the rib may be positioned 2¼ inches forward of abutment surface 234. Each rib has a rib crest 252 positioned 5¼ inches horizontally forward of abutment surface 234 and may have a height of ⅜ inches above the flat base surface. Each rib has a second trough portion 254 which may be the front terminal end of the rib and may be positioned 10 inches horizontally forward of abutment surface 234 and may have a height of about ⅛ inch above the base surface. The forward end of each rib may terminate at a shoulder surface 258 which is in turn connected to an upwardly and forwardly ramping surface 256. The top of the shoulder surface 258 may have the same height as the second trough 254 of each rib. The forward edge 260 of the upwardly ramping surface may be positioned 11½ inches horizontally forwardly of abutment surface 234. The front edge 260 of the upwardly ramping surface intersects a top surface 264 of a horizontally extending front rim portion 262. The top surface 264 is coplanar with the top surfaces 223 and 229 of the guide rails 222, 226. The front rim 260 and the upwardly ramping surface 256 are integrally connected with a generally truncated converging half pipe-shaped portion 265 which terminates in an inverted handlebar mustache-shaped portion 266. The truncated converging half pipe-shaped portion 265 includes a curved, concave upward surface 267 which intersects the upwardly ramping surface 256 at intersection lines 269, 271 which in turn intersect at point 273 at the shoulder 258 of upwardly ramping surface 256. The inverted handlebar mustache-shaped portion 266 comprises a first laterally extending handlebar portion 268 having a slightly inwardly and downwardly curving upper surface 270 which may have a radius of curvature of about 1¾ inches. The handlebar portion 268 may comprise a rear surface 272 sloping downwardly and rearwardly which is a continuation of upwardly and forwardly ramping surface 256. The inverted handlebar mustache-shaped portion may have a second laterally extending handlebar portion 276 which may be a mirror image of portion 268. The highest points on the handlebar portions forms a second crest of the sinusoidal support surface and may be about 1 inch higher than the first trough portion 250. The inverted handlebar mustache-shaped portion 266 may comprise an intermediate portion 280 having a generally bow-shaped upper surface 282 which is a continuation of surface 267 and which may have a radius of curvature "r" shown in FIG. 12 of about 5½ inches. As previously discussed, the inverted, mustache-shaped portion 266 intersects the upwardly ramping surface 256 at intersection lines 269, 271. The depth "m" of the bow-shaped portion below a plane MM across the top of the handlebar-shaped portion may be approximately ¾ inch. The truncated converging half pipe-shape of portion 265 causes a slight gap, e.g. 1/16 inch (FIG. 15) between the surface of an 8 and ½ inch long piece of paper supported on the lower support tray and the upper surface 282 of the inverted mustache-shaped portion 266 such that a person may slide his or her finger underneath the sheet of paper to lift it from the tray. If a longer sheet of paper is supported in the lower tray, the gap increases with the length of the paper until the terminal end of the paper is even with the vertically extending face 288 of the inverted mustache-shaped portion.

It will be appreciated from the foregoing description of the upper sheet support tray and also from the descriptions of bow-forming surfaces, such as illustrated in FIGS. 5–8, that the truncated converging half pipe-shaped portion 265 and particularly the inverted handlebar mustache-shaped portion 266 thereof is a sheet bow-forming structure. At the inverted mustache shaped portion 266 this bow-forming structure has a depth m of about ¾ inches and a width n of about 6⅛ inches and is capable of supporting sheet in a generally horizontally erect state at a length substantially longer, e.g. at least 25% longer, than the critical overhang length of the paper due to the bow formed in the paper by the inverted handlebar mustache-shaped portion. The bow formed may have a radius of curvature greater than that of the bow of the inverted mustache-shaped portion if the paper supported is sufficiently stiff to prevent deformation to the entire depth m of the inverted mustache-shaped portion. However, the paper may be made to more closely assume the shape of the inverted mustache-shaped portion by urging the paper downwardly as by positioning one's hand on the paper and pushing downwardly or through the force of gravity due to the weight of a stack of paper supported on the lower paper support tray. Even after release of such downward pressure the paper tends to stay in this more bow-shaped configuration which in turn allows for greater horizontal projection of the paper from the tray end without drooping. A similar bow-forming process occurs in the upper support tray as well, except that there is no lower limit to the deformation of the paper provided by a support surface and thus, the paper itself will provide the maximum limit of deformation. It is to be appreciated that the bow-forming portion of both the upper tray and the lower tray are provided only at the front ends thereof. This configuration allows the paper to maintain a generally, horizontally-flat orientation across the rear longitudinal end thereof facilitating interface with the paper infeed mechanism 290, etc. of the ADF associated with the upper tray 90 and the paper discharge mechanism 292, etc. associated with the lower tray 210. Thus, only the forward end 12 of a sheet supported in each of these support trays is placed in the bow-shaped configuration which provides longitudinal rigidity while enabling the rear end portion 14 of the paper to remain relatively flexible and positioned in a generally laterally flat orientation on the associated tray.

Figure 14:
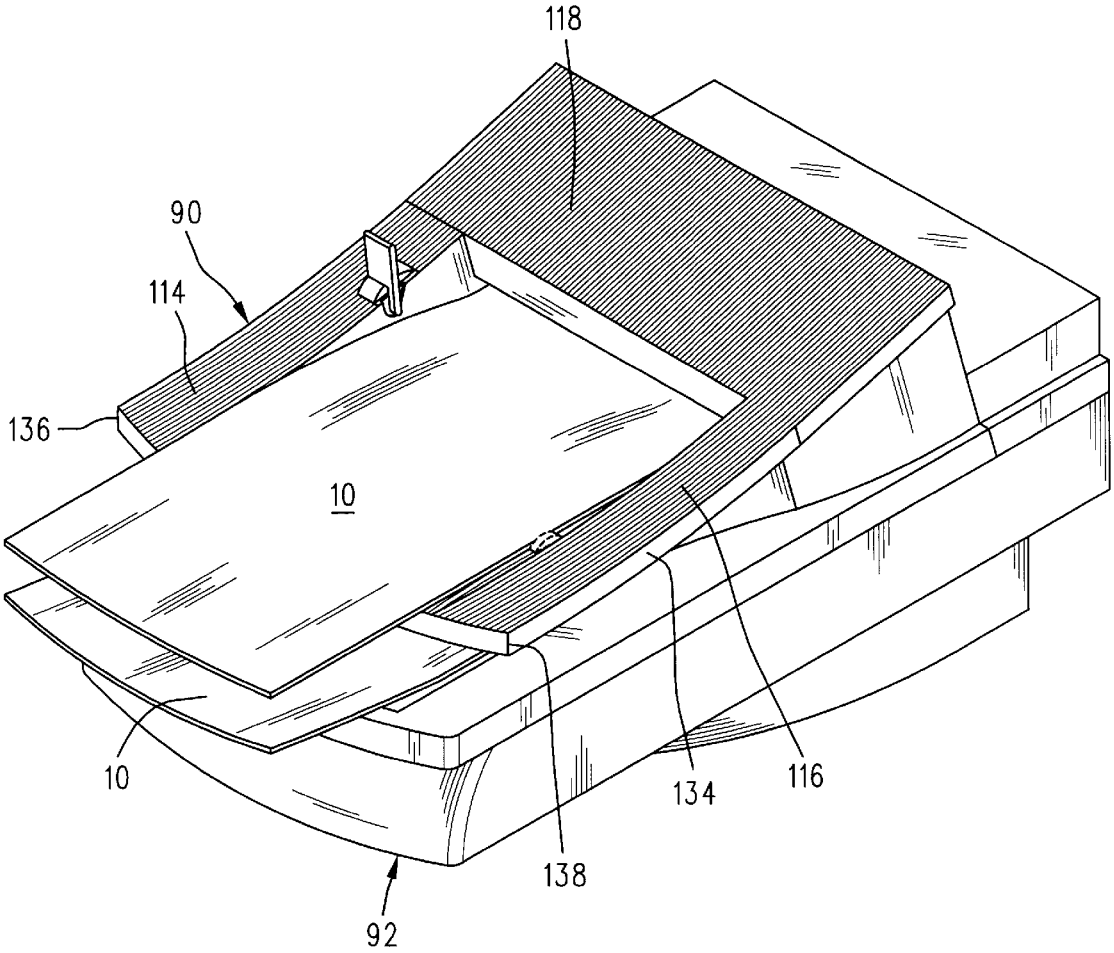
FIG. 14 is a perspective view of the automatic document feeder of FIG. 10 having sheets of paper supported in the upper and the lower trays.
Figure 15:
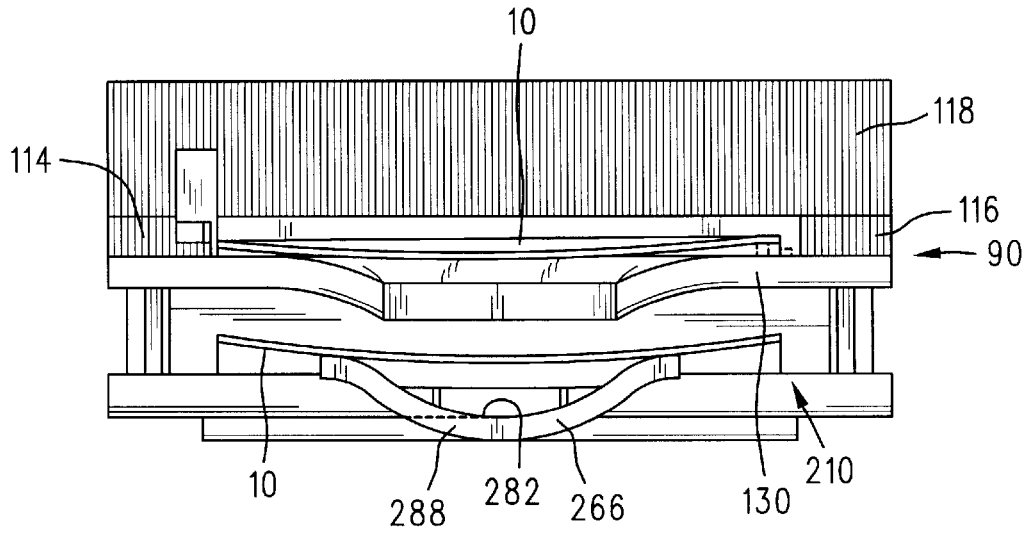
FIG. 15 is an end view identical to FIG. 12, except showing sheets of paper supported in the upper and the lower trays.

FIG. 14 illustrates sheets of paper 10 supported on both the upper support tray and the lower support tray without drooping at a distance beyond the critical overhang length of the paper. FIG. 15 is an end view of FIG. 14.

Figure 16:
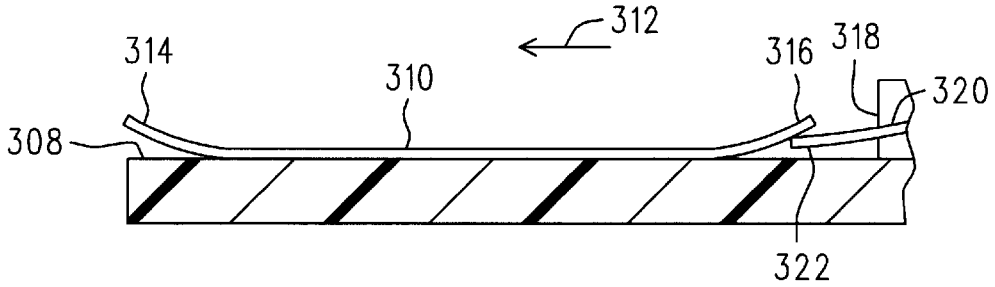
FIG. 16 is a schematic side elevation view of a document discharge port and associated planar support tray having a sheet of paper with upwardly curled leading and trailing edges supported thereon.
Figure 17:
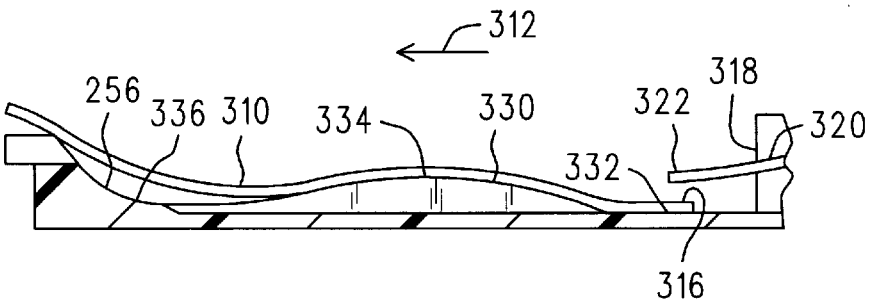
FIG. 17 is a schematic side elevation view of a document discharge port and associated support tray having a sinusoidal support surface and having a sheet of paper with normally upwardly curled leading and trailing edges supported thereon in a relatively decurled configuration.

FIG. 16 illustrates a problem associated with the discharge of sheets of paper onto a flat paper support tray 308. A sheet 310 is discharged into the support tray 308 in feed direction 312 and comprises a leading edge 314 and a trailing edge 316 which tend to curl upwardly after the paper is discharged from paper discharge port 318. This upward curling of the edge of the paper may be produced as when paper is fed through a laser printer or some other device which causes differential heating of the paper. Each upwardly curved end may rise as much as 1 inch or more. The problem with discharging paper having curled-up ends onto a flat support tray 308 is that an incoming sheet of paper 320 having a leading edge portion 322 may come into contact with a trailing edge portion 316 of the first sheet causing the leading edge of the incoming sheet to be driven under, rather than over, the first sheet and tending to cause paper jams in the support tray and/or disturbing the order of the sheets. FIG. 17 illustrates the support of sheet 310 on a sinusoidal support surface 330 having a first trough 332, a crest 334, and a second trough 336 such as that described for the rib portions of the lower support tray 210. It may be seen that this sinusoidal support surface shape causes the ends of the paper 314, 316 to be positioned in a generally flat orientation on the support tray resulting in the leading edge 322 of the next incoming sheet of paper passing over, rather than under, the trailing edge 316 of the first sheet and avoiding paper jams. It has also been discovered that causing the leading edge 314 of the sheet to move upwardly over a support surface such as provided by the upwardly ramping surface 256 of the lower support tray results in improved paper handling by slowing the movement of the paper out of the tray to prevent the paper from sliding out of the try, even in a paper tray configuration where the paper does not project outwardly from the tray sufficiently such that it needs a bow formed at the end thereof for overhang rigidity.

It is contemplated that the inventive concepts herein described may be variously otherwise embodied and it is intended that the appended claims be construed to include alternative embodiments of the invention except insofar as limited by the prior art.

What is claimed is:

1. A sheet support tray for use with a sheet processing machine of the type which discharges sheets from a discharge port in a longitudinally extending downstream direction with a leading longitudinal end of each discharged sheet exiting the machine first and a trailing longitudinal end of each discharged sheet exiting the machine last and wherein said sheets have leading and trailing ends which curl upwardly when the sheet is positioned on a flat surface comprising:

a first laterally extending sheet support portion which supports a portion of a curled end sheet in contact therewith at a first height;

a second laterally extending sheet support portion positioned downstream from said first sheet support portion which supports a portion of a curled end sheet in contact therewith at a second height sufficiently greater than said first height to cause said trailing end of a sheet supported thereon to be positioned in substantially tangential relationship with said first laterally extending sheet support portion, whereby interference between said trailing end of said supported sheet and a leading end of the next incoming sheet is obviated;

said first and second laterally extending sheet support portions comprising portions of a sine wave shaped sheet support surface.

2. The sheet support tray of claim 1 further comprising:

a third laterally extending sheet support portion positioned downstream from said second portion which supports a portion of a sheet in contact therewith at a third height less than said second height;

a fourth laterally extending sheet support portion positioned downstream from said third portion which supports a portion of a sheet in contact therewith at a fourth height greater than said third height.

3. A sheet support tray for sequentially receiving and supporting a plurality of incoming sheets which have leading and trailing ends which curl upwardly when the sheets are positioned on a flat surface comprising:

an upstream end portion and a downstream end portion;

a sine wave shaped sheet support portion extending between said tray end portions and having at least one crest and two troughs, said crest being of a height sufficiently greater than that of an upstream one of said troughs to cause said trailing end of a sheet supported thereon to be positioned in substantially tangential relationship with said sine wave shaped sheet support portion whereby interference between said trailing end of said supported sheet and a leading end of the next incoming sheet is obviated.

4. The sheet support tray of claim 3, said sine wave shaped sheet support portion having a first trough positioned proximate said upstream end portion, a first crest positioned downstream from said first trough, a second trough positioned downstream from said first trough and a second crest positioned proximate said downstream end and downstream from said second trough.

5. The sheet support tray of claim 4, said sine wave shaped sheet support portion comprising a plurality of longitudinally extending ribs.

6. The sheet support tray of claim 4, said first crest having a maximum height about ⅜ inches higher than said first trough.

7. The sheet support tray of claim 6, said second crest having a maximum height about 1 inch higher than said first trough.

8. The sheet support tray of claim 4, said second crest having a maximum height of about 1 inch higher than said first trough.

9. The sheet support tray of claim 3, said sine wave shaped sheet support portion comprising a plurality of longitudinally extending ribs.

10. A sheet support tray comprising:

an upstream end portion and a downstream end portion;

a sine wave shaped sheet support portion extending between said end portions and having at least one crest and two troughs;

said sine wave shaped sheet support portion having a first trough positioned proximate said upstream end portion, a first crest positioned downstream from said first trough, a second trough positioned downstream from said first trough and a second crest positioned proximate said downstream end and downstream from said second trough;

a portion of said sine wave-shaped sheet support portion which extends from between said second trough and said second crest comprising a generally truncated converging half pipe-shaped portion having a lower surface portion and opposite upper edge portions.

11. The sheet support tray of claim 10, said generally truncated converging half pipe-shaped portion being constructed and arranged to form a gap between a sheet of paper supported thereon and said lower surface portion thereof to facilitate easy insertion of an operator's finger below the sheet of paper to enable easy grasping and removal of the sheet of paper from the tray.

12. The sheet support tray of claim 10, said generally truncated converging half pipe-shaped portion terminating in a generally inverted handlebar mustache-shaped portion.

13. A method of supporting a sheet of paper having a curled up trailing edge comprising:

placing the sheet in contact with a tray having a sine wave shaped support surface; and elevating a mid portion of the sheet sufficiently so that a trailing edge portion of the sheet is positioned in about a tangential orientation with the surface of the tray.

14. A method of supporting a sheet of paper having a curled up trailing edge on a support tray comprising:

placing the sheet in contact with the tray; and elevating a mid portion of the sheet sufficiently so that a trailing edge portion of the sheet is positioned in about a tangential orientation with the surface of the tray;

providing a finger insertion gap between a leading edge portion of the sheet and a lower surface of the support tray by placing the leading edge of the sheet in contact with a generally truncated converging half pipe-shaped structure on said support tray.

15. A method of moving a sheet of paper across the surface of a support tray comprising:

initially urging a first end portion of the sheet against a first surface portion of the support tray;

next elevating the first end portion of the sheet by urging it against a second surface portion of the support tray;

next lowering the first end portion of the sheet by urging it against a third surface portion of the support tray;

next raising the first end portion of the sheet by urging it against a fourth surface portion of the support tray;

maintaining an intermediate portion of the sheet at a relatively elevated position with respect to a second end portion of the sheet by urging the intermediate portion of the sheet against the second surface portion of the support tray and urging the second end portion of the sheet against the first surface portion of the support tray; and maintaining a gap between the first end portion of the sheet and the support tray by placing the first end portion in contact with a generally truncated converging half pipe-shaped surface region of said fourth surface portion of the support tray.

16. A sheet support tray for supporting incoming sheets of paper having normally curled up leading and trailing edge portions comprising:

an upstream end portion and a downstream end portion;

a continuous, smoothly curving, sine wave shaped sheet support portion extending between said end portions and having at least one crest and two troughs and constructed and arranged to support said sheets of paper such that the trailing edges are positioned tangential to said sheet support surface whereby interference between the trailing edge of a supported sheet and the leading edge of the next incoming sheet is obviated.

17. A sheet support tray comprising:

an upstream end portion and a downstream end portion;

a continuous, smoothly curving, sine wave shaped sheet support portion extending between said end portions and having at least one crest and two troughs;

said sine wave shaped sheet support portion having a first trough positioned proximate said upstream end portion, a first crest positioned downstream from said first trough, a second trough positioned downstream from said first trough and a second crest positioned proximate said downstream end and downstream from said second trough, said sine wave shaped sheet support portion comprising a plurality of longitudinally extending ribs extending at least from said first crest to said second trough.

* * * * *